US005181530A

United States Patent [19]

Chou

[11] Patent Number: 5,181,530

[45] Date of Patent: Jan. 26, 1993

[54] HAIR CLIP

[76] Inventor: Kuo-Hua Chou, 9-1, Lane 161, Hsing An Road Sec. 1, Taichung, Taiwan

[21] Appl. No.: 800,470

[22] Filed: Nov. 29, 1991

[51] Int. Cl.[5] ..... A45D 8/22

[52] U.S. Cl. ..... 132/279; 132/275; 132/278

[58] Field of Search ..... 132/275, 276, 277, 278, 132/279

[56] References Cited

U.S. PATENT DOCUMENTS

| | | | |
|---|---|---|---|
| 2,168,369 | 8/1939 | Solomon | 132/278 |
| 2,170,636 | 8/1939 | Graham | 132/278 |
| 2,170,778 | 8/1939 | Huppert | 132/278 |
| 2,461,934 | 2/1949 | Solomon | 132/278 |
| 2,513,166 | 6/1950 | Goodman | 132/278 |
| 3,055,377 | 9/1962 | Guinett et al. | 132/275 |
| 3,704,717 | 12/1972 | Morand et al. | 132/279 |
| 4,991,607 | 2/1991 | Chen | 132/278 |

FOREIGN PATENT DOCUMENTS

| | | | |
|---|---|---|---|
| 2455444 | 1/1981 | France | 132/279 |
| 440897 | 10/1949 | Italy | 132/279 |

*Primary Examiner*—Gene Mancene
*Assistant Examiner*—Frank A. LaViola

[57] ABSTRACT

A barrette comprises an elongate, arched holder made from a plastic strip and an elongate, arched metal clip member. The holder has embossed end portions which are folded against the concave side of the holder and held in place by clamping tabs extending from the longitudinal edges thereon, with each folded end portion having a raised embossment defining a receiving cavity with an L shaped entrance slit around a periphery thereon. Opposing end portions of the clip member are inserted laterally into corresponding cavities on the holder and retained therein by cooperating snap appendages and engagement surfaces including a protruding catch on each end portion of the clip member which engages a rectangular aperture on a corresponding raised embossment. Further securement is provided by an inclined catch on the inner terminal edge of each folded end portion which snap engages a corresponding aperture on the clip member.

12 Claims, 6 Drawing Sheets

HAIR CLIP

BACKGROUND OF THE PRESENT INVENTION

The present invention relates to a barrette and more particularly to a barrette having a plastic holder and a metal clip member that is easily and quickly assembled therewith.

Conventional barrettes usually comprise an arcuate metal clip which carries an assembly of pivotable bars and locking elements for the actual clamping of a tress of hair, and an arcuate, usually broader, plastic holder or bar to which the clip is attached. The outer side of the holder can be decorated or adorned with various ornamental appendages, such as jewelry, lace, and the like. Achieving a proper method of attachment between the plastic holder and metallic clip which can provide ample securement while still being amenable to rapid and economical assembly has proven to be problemmatical with various techniques having been brought forth and implemented. FIG. 1 shows one such technique wherein opposing end portions of an arcuate metallic clip member 1 are pierced in such manner as to form holes 2 therein having a plurality of jagged protrusions 3 that flare outwards therefrom. A plastic, conformingly curved holder 4 disposed above the clip member is brought into contact with the pointed protrusions 3 while the immediate area is heated with hot iron A so as to cause the plastic to soften and allow the protrusions to embed therein under pressure. The clip member is thus fixedly secured to the holder after both end portions thereon are so connected. A related method is shown in FIG. 2 wherein a plastic holder is provided with preformed projections 8 which pass through respective holes 6 on the end portions of a clip member 5 when positioned thereagainst. A heated, conformingly shaped former is then pressed against the exposed end of each projection 8 so as to deform the projection into a roughly mushroom shaped rivet 9.

Though both of the above conventional methods of joining a plastic holder with a metal clip member can provide a firm securement and can be implemented with holders and clip members of simple structure, they are generally not compatible with rapid, economical, and safe production. Firstly, the heating process required in both techniques tends to be relatively slow and requires greater expenditures of energy to supply the requisite heat. Secondly, the local fusing of the plastic material in the holders generates noxious fumes which make the production site unfit for workers and which moreover poses a considerable fire hazard if special precautions are not taken.

The barrette of the present invention was accomplished in light of the above disadvantages and aims to provide a barrette structure comprising a plastic holder and metal clip member which can be quickly and economically assembled using only mechanical means while maintaining the integrity of the combined structure so as to provide a durable and reliable barrette.

SUMMARY OF THE PRESENT INVENTION

A barrette in accordance with the present invention comprises an elongate, arched holder formed from a plastic strip and an elongate, arched metal clip member carrying a clamping assembly for clamping a tress of hair. The longitudinal end portions of the holder are folded into abutment with the concave underside of the holder to define respective fold portions which have formed thereon embossed protrusions that are adjacent to a lateral periphery thereof. Each protrusion defines a receiving cavity having an entrance slit that extends along a portion of the lateral periphery common with the corresponding fold portion so as to enable the intromission of the longitudinal end portions of the clip member therein. Securement of the end portions of the clip member within the receiving cavities is provided by snap engaging means in the form of upwardly and downwardly directed snap appendages on the end portions of the clip member and protrusions which engage cooperating surfaces on the conjugal members to inhibit the retraction of the clip member from the holder.

It is thus a main object of the present invention to provide a barrette as characterized wherein a metallic clip member can be attached to a plastic holder by direct lateral insertion therein without need for further securement steps or pre-bending of the clip member.

A further object of the present invention is to provide a barrette as characterized which is amenable to rapid and economical production.

Yet another object of the present invention is to provide a barrette as characterized which can allow interchange of the metallic clip member therein.

A more thorough understanding of the barrette of the present invention and its manufacture will be attained by reference to a detailed description of a preferred embodiment thereof provided below along with accompanying drawings referred to therein.

DETAILED DESCRIPTION OF THE PREFERRED EMBODIMENT

Referring to FIGS. 3 to 7 of the drawings, the barrette of the present invention comprises an elongate, arched holder 10 made from a plastic strip, and an elongate, arched clip 20 made from stamped metal strip and carrying a hair clamping assembly similar with those found on more conventional barrette structures.

Figure 3:
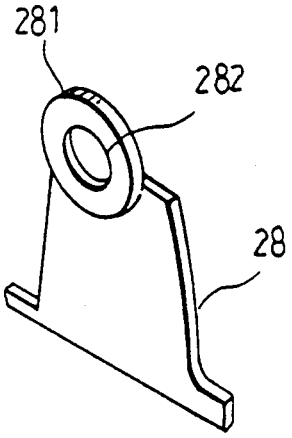
FIG. 3 is a plan view showing a plastic strip from which a holder of the barrette is formed prior to folding inwards the terminal end portions thereof.

As shown in FIG. 3, each longitudinal end of the plastic strip from which the elongate holder 10 is formed has a generally rectangular fold portion 12 and a pair of clamping tabs 17 spaced inwards therefrom that protrude from respective longitudinal edges of the strip. A generally rectangular depressed embossment 13, as indicated by the embossment line 131 in the figure, is formed in each fold portion 12 adjacent to an outer corner periphery thereof. Embossments 13 are each provided with a generally rectangular aperture 14 on a roughly central portion thereof and an upwardly inflected, incised catch 15 adjacent to the common corner of the fold section and embossment. A notch 191 is formed on a first longitudinal edge of each fold portion spaced from the embossment therein and a notch 192 is formed on the other longitudinal edge of the fold portion that is in alignment with the embossment, with notch 192 being adjacent therewith.

Figure 1:
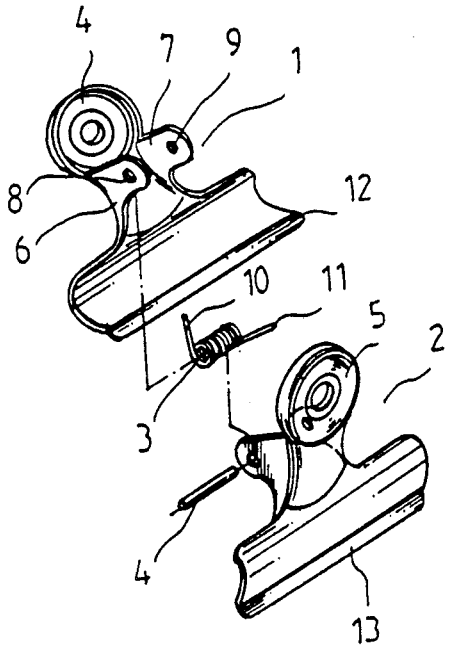
FIG. 1 is a schematic view showing a first conventional method of achieving securement between a plastic holder bar and metal clip member of a barrette structure of the prior art.
Figure 2:
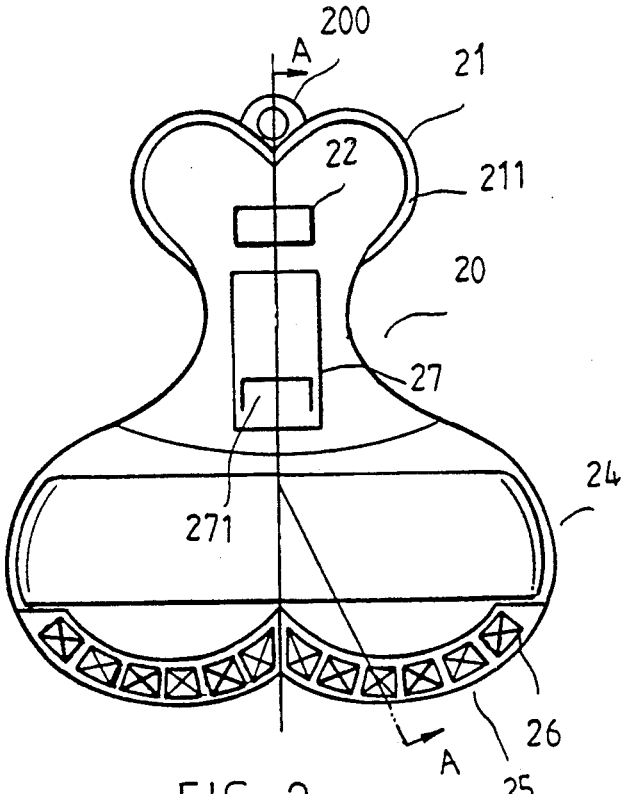
FIG. 2 is a schematic view showing a second conventional method of achieving securement between a plastic holder bar and metal clip member of a barrette structure of the prior art.
Figure 4:
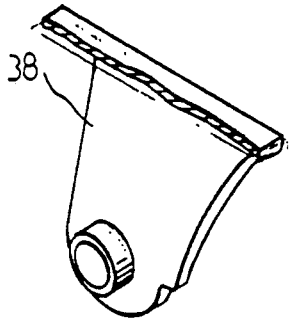
FIG. 4 is a plan view showing the holder with the fold portions formed thereon.
Figure 5:
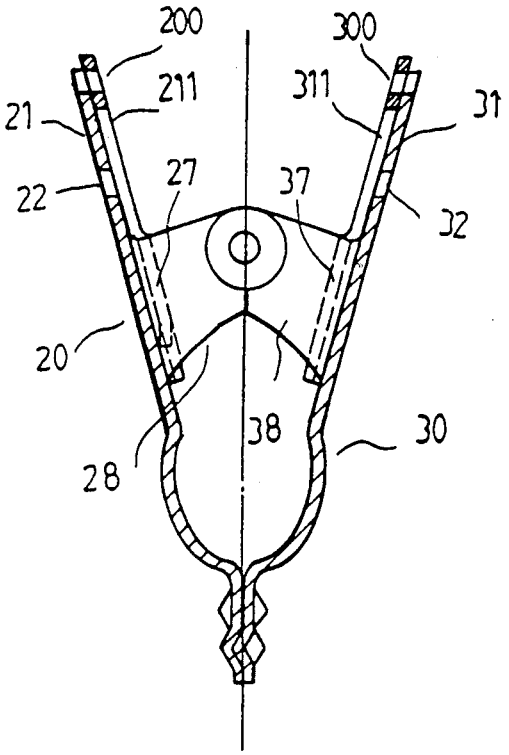
FIG. 5 is a sectional view taken along line 1—1 of FIG. 4.
Figure 6:
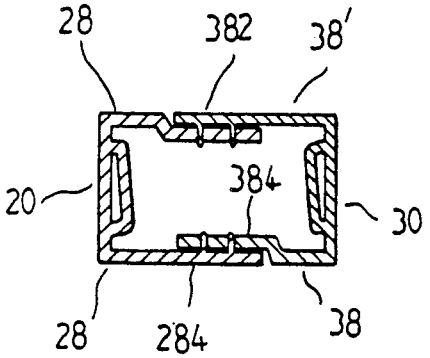
FIG. 6 is a sectional view taken along line 2—2 of FIG. 4.

Each fold portion 12 on the strip is folded against the concave side thereon to form the configuration of FIG. 4. Clamping tabs 17 of each fold portion are folded around corresponding notches 191,192 in registry therewith and into abutment with the exposed surface of the fold portion. Embossments 13 which are now spaced from the lower surface of the holder define respective receiving cavities 16 on the concave under side thereof, as shown in FIGS. 5 and 6. The openings between the surface of the holder and the raised corner periphery of each embossment 13 define respective roughly L shaped entrance slits 18 around each cavity 16 that extend along a longitudinal edge portion of the holder and across a lateral width portion thereof.

Figure 7:
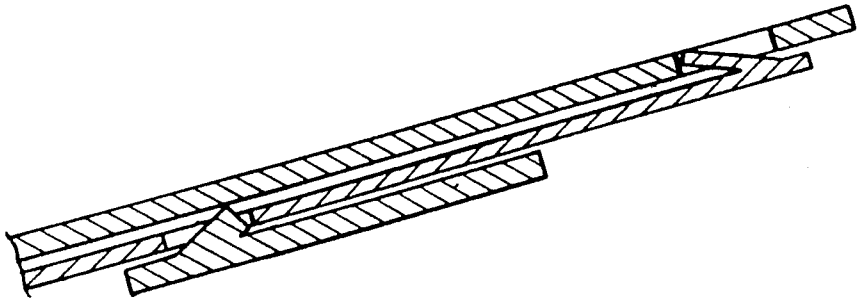
FIG. 7 is a perspective view showing a portion of the assembled barrette with a metal clip member secured in place on the holder.
Figure 8:
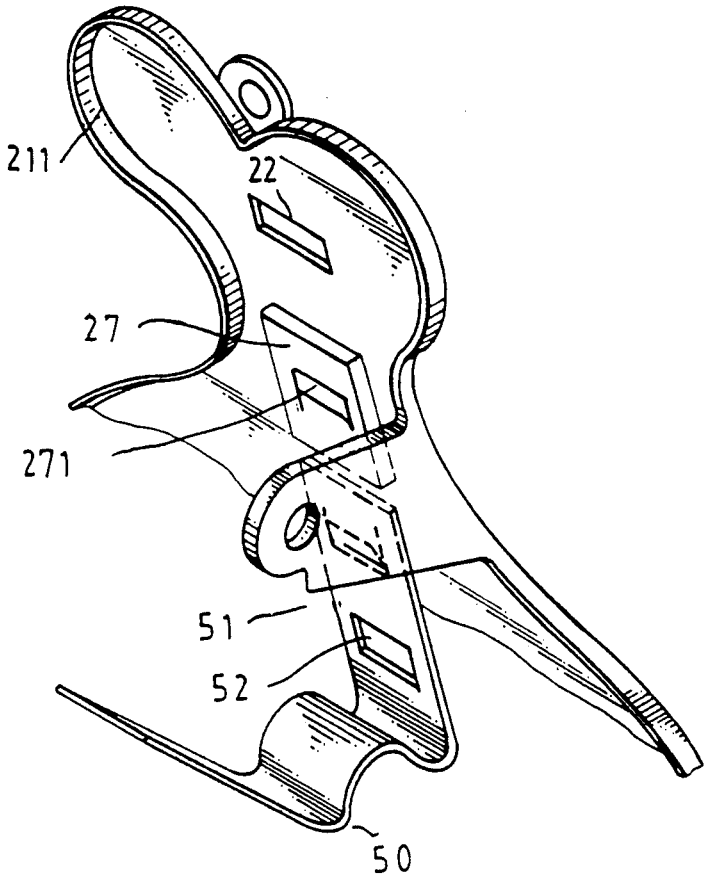
FIG. 8 is a sectional view taken in a lateral direction showing the arrangement of snap appendages and engaging surfaces used to secure the clip member to the holder.

The longitudinal end portions of a base 21 of the clip 20 can thus be inserted into respective receiving cavities 16 of the holder through entrance slits 18 thereon, as in FIG. 7. The separation between the embossment and the surface of the holder is substantially equal with the thickness of base 21 so as to prevent rattling or looseness therein. Each end portion of base 21 is retained within a corresponding cavity 16 by an inclinate catch 211 formed thereon which deflects towards the surface of the holder when the end portion is inserted into the cavity and snap engages the corresponding aperture 14 when brought into registry therewith to inhibit the retraction of the clip from the holder. As shown in FIG. 8, further securement is provided by the snap engagement of catch 15 on the terminal edge of each fold portion with a corresponding aperture **21*a*** in the respective end portions of the clip.

Figure 9:
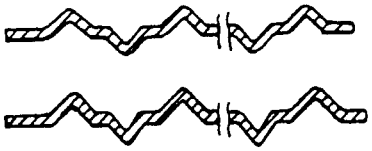
FIG. 9 is a plan view showing an alternate embodiment of the snap fit securement means for use between the clip member and holder.
Figure 10:
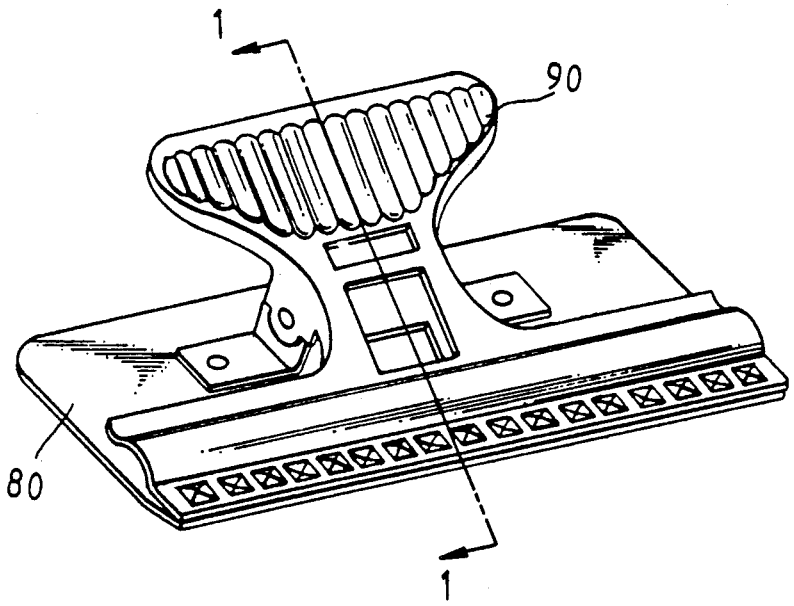
FIG. 10 is a sectional view taken in a lateral direction showing the arrangement of snap appendages and engaging surfaces in the embodiment of FIG. 9.
Figure 11:
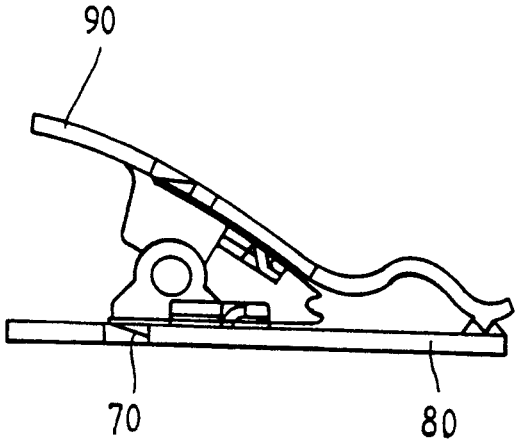
Figure 8:
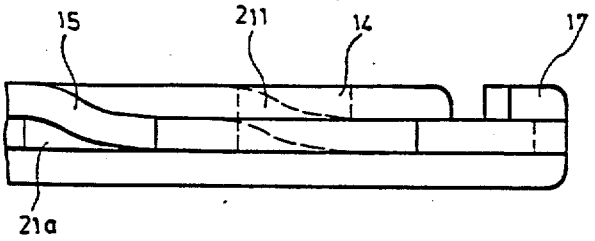
Figure 10:
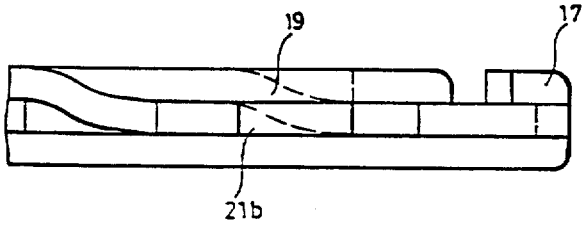
Figure 9:
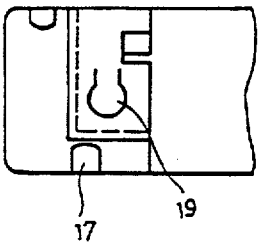
Figure 1:
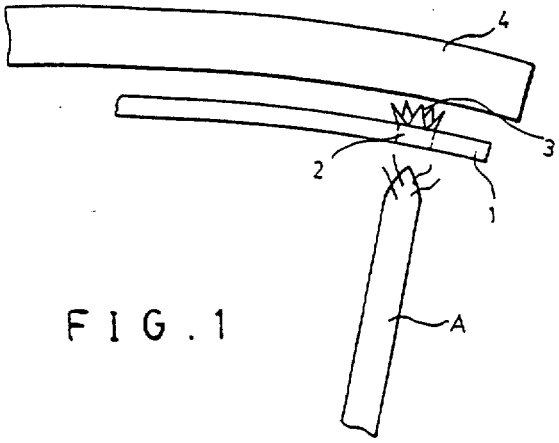
Figure 2:
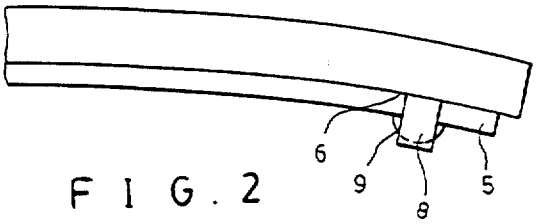
Figure 6:
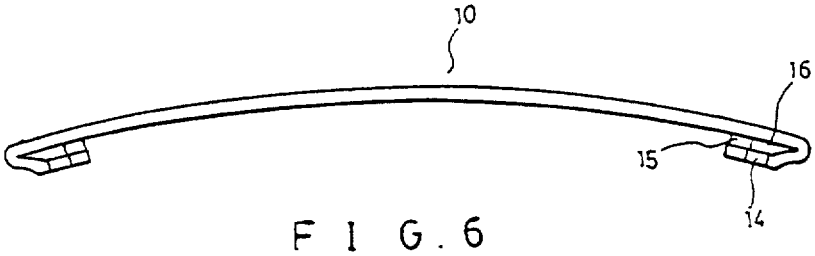
Figure 4:
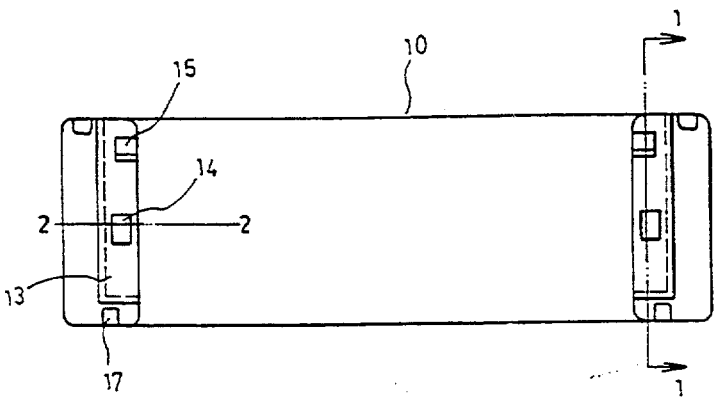
Figure 5:
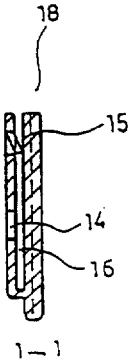
Figure 3:
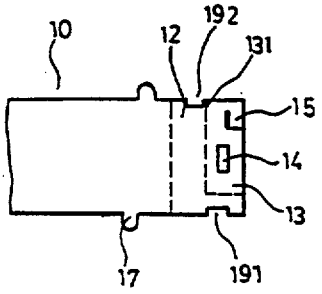
Figure 7:
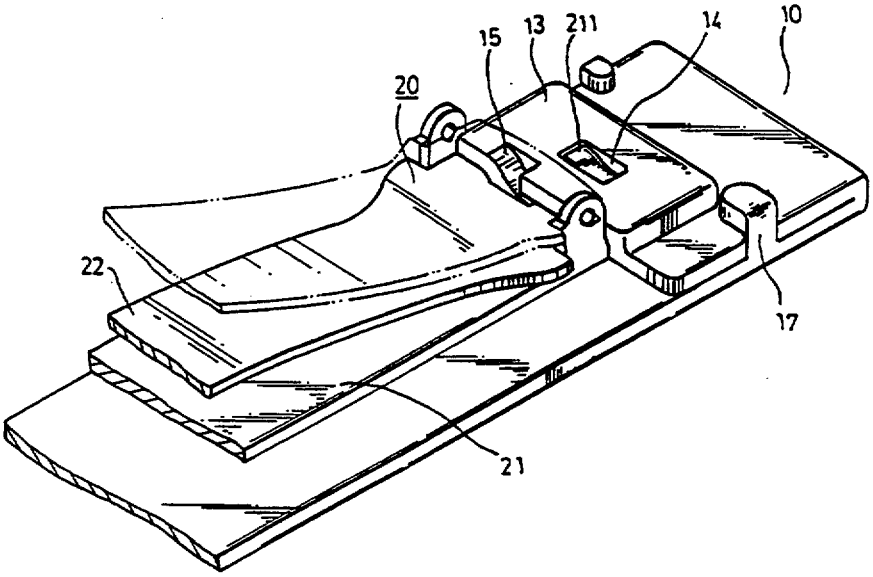

FIGS. 9 and 10 show an alternate snap fit securement arrangement wherein a resilient catch 19 of generally semicircular shape is provided instead on the embossment and is recessed therefrom to snap engage a cooperating circular aperture **21*b* in an end portion of base 21** when inserted within a corresponding cavity.

As in the clip members of more conventional barrettes, clip 20 carries a clamping assembly including a pivotable clamping bar 22, as shown in FIG. 7, hingedly attached to base 21 as well as other elements which function in the conventional manner.

Many further variations to the barrette of the present invention could also be accomplished by a person of average skill in the art without departing from the scope thereof. As such, the spirit and scope of the present invention should not be limited by the specificities related to the above embodiment but instead should be determined from the appended claims and their legal equivalents.

I claim:

1. A barrette comprising an elongate arched plastic holder and an elongate arched metal clip member carrying a clamping assembly for clamping a tress of hair, wherein:

longitudinal end portions of said holder are folded into abutment with a concave side of said holder to define respective fold portions;

an embossed protrusion is formed on each said fold portion adjacent with a lateral periphery thereon, each said protrusion being spaced from said holder to define respective receiving cavities;

each said receiving cavity has an entrance slit formed along said lateral periphery of a corresponding said fold portion for intromitting a longitudinal end portion of said clip member into said receiving cavity in a substantially lateral direction with respect to said holder;

a snap engaging means is provided between each said end portion of said clip member and a corresponding said receiving cavity for securing said end portion of said clip member therein, each said snap engaging means including at least one elastic appendage which engages a cooperating surface to inhibit the retraction of a said end portion of said clip member from a corresponding said receiving cavity.

2. A barrette according to claim 1, wherein said fold portions of said holder and said protrusions thereon are generally rectangular.

3. A barrette according to claim 2, wherein said entrance slit of each said receiving cavity is roughly L shaped.

4. A barrette according to claim 3, wherein each said protrusion is adjacent to a terminal edge of a corresponding said fold portion of said holder opposite from the foldline therebetween, and each said entrance slit extends along a portion of one longitudinal edge of said holder and across a lateral portion thereof.

5. A barrette according to claim 4, wherein said snap engaging means comprises a retaining aperture formed on each said protrusion and a cooperating inclinate protruding catch formed on each said end portion of said clip member at a predetermined position thereon which snap engages a corresponding said aperture when said end portions of said clip member are inserted into corresponding said receiving cavities.

6. A barrette according to claim 5, wherein said retaining aperture is generally rectangular.

7. A barrette according to claim 6, wherein each said protrusion further includes a declinate recessed catch adjacent to said terminal edge of a corresponding said fold portion, said recessed catch engaging a cooperating surface on a corresponding end portion of said clip member.

8. A barrette according to claim 7, wherein said holder further includes at least one clamping tab provided at a predetermined position on a longitudinal edge portion of said holder adjacent each said fold portion thereof, each said tab being folded against the surface of a corresponding said fold portion.

9. A barrette according to claim 4, wherein said snap engaging means comprises a retaining aperture formed at a predetermined position on each end portion of said clip member and a cooperating incised recessed catch formed on each said protrusion which snap engages a corresponding said aperture when said end portions of said clip member are inserted into corresponding said receiving cavities.

10. A barrette according to claim 9, wherein said retaining aperture is generally circular.

11. A barrette according to claim 10, wherein each said protrusion further includes a declinate recessed catch adjacent to said entrance slit, said recessed catch engaging a cooperating surface on a corresponding end portion of said clip member.

12. A barrette according to claim 11, wherein said holder further includes at least one clamping tab provided at a predetermined position on a longitudinal edge portion of said holder adjacent each said fold portion thereof, each said tab being folded against the surface of a corresponding said fold portion.

* * * * *

UNITED STATES PATENT AND TRADEMARK OFFICE

CERTIFICATE OF CORRECTION

PATENT NO. : 5,181,530

DATED : January 26, 1993

INVENTOR(S) : Kuo-Hua Chou

It is certified that error appears in the above-indentified patent and that said Letters Patent is hereby corrected as shown below:

The title page, showing the illustrative figure, should be deleted and substitute therefor the attached title page.

The drawing sheets consistings of Figs. 1-10 should be deleted to be replaced with the drawings sheets consistings of figs. 1-10 as shown on the attached pages.

Signed and Sealed this

Eighth Day of November, 1994

*Attest:*

Bruce Lehman

BRUCE LEHMAN

*Attesting Officer*

*Commissioner of Patents and Trademarks*

US005181530A

United States Patent [19]

Chou

[11] Patent Number: 5,181,530

[45] Date of Patent: Jan. 26, 1993

[54] HAIR CLIP

[76] Inventor: Kuo-Hua Chou, 9-1, Lane 161, Hsing An Road Sec. 1, Taichung, Taiwan

[21] Appl. No.: 800,470

[22] Filed: Nov. 29, 1991

[51] Int. Cl.[5] ..... A45D 8/22

[52] U.S. Cl. ..... 132/279; 132/275; 132/278

[58] Field of Search ..... 132/275, 276, 277, 278, 132/279

[56] References Cited

U.S. PATENT DOCUMENTS

| | | | |
|---|---|---|---|
| 2,168,369 | 8/1939 | Solomon | 132/278 |
| 2,170,636 | 8/1939 | Graham | 132/278 |
| 2,170,778 | 8/1939 | Huppert | 132/278 |
| 2,461,934 | 2/1949 | Solomon | 132/278 |
| 2,513,166 | 6/1950 | Goodman | 132/278 |
| 3,055,377 | 9/1962 | Guinett et al. | 132/275 |
| 3,704,717 | 12/1972 | Morand et al. | 132/279 |
| 4,991,607 | 2/1991 | Chen | 132/278 |

FOREIGN PATENT DOCUMENTS

| | | | |
|---|---|---|---|
| 2455444 | 1/1981 | France | 132/279 |
| 440897 | 10/1949 | Italy | 132/279 |

*Primary Examiner*—Gene Mancene
*Assistant Examiner*—Frank A. LaViola

[57] ABSTRACT

A barrette comprises an elongate, arched holder made from a plastic strip and an elongate, arched metal clip member. The holder has embossed end portions which are folded against the concave side of the holder and held in place by clamping tabs extending from the longitudinal edges thereon, with each folded end portion having a raised embossment defining a receiving cavity with an L shaped entrance slit around a periphery thereon. Opposing end portions of the clip member are inserted laterally into corresponding cavities on the holder and retained therein by cooperating snap appendages and engagement surfaces including a protruding catch on each end portion of the clip member which engages a rectangular aperture on a corresponding raised embossment. Further securement is provided by an inclined catch on the inner terminal edge of each folded end portion which snap engages a corresponding aperture on the clip member.

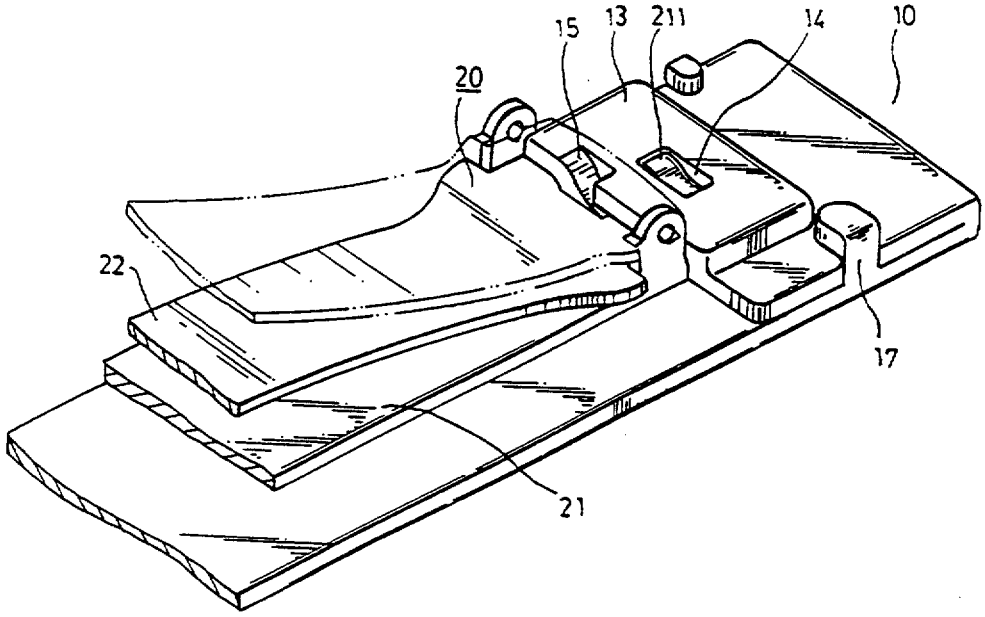

12 Claims, 3 Drawing Sheets